US008662177B2

(12) United States Patent
O'Malley

(10) Patent No.: US 8,662,177 B2
(45) Date of Patent: Mar. 4, 2014

(54) HYDRAULIC FRACTURE DIVERTER APPARATUS AND METHOD THEREOF

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 370 days.

(21) Appl. No.: 13/036,106

(22) Filed: Feb. 28, 2011

(65) Prior Publication Data

US 2012/0217013 A1 Aug. 30, 2012

(51) Int. Cl.
*E21B 43/26* (2006.01)
*E21B 43/04* (2006.01)
*E21B 17/10* (2006.01)

(52) U.S. Cl.
USPC ..... 166/308.1; 166/51; 166/241.6; 166/278

(58) Field of Classification Search
USPC ..... 166/308.1, 51, 278, 177.5, 242.1, 166/241.6, 192, 387; 175/325.5
See application file for complete search history.

(56) References Cited

U.S. PATENT DOCUMENTS

| | | | | |
|---|---|---|---|---|
| 3,351,136 | A * | 11/1967 | Nelson | 166/173 |
| 5,417,285 | A | 5/1995 | Van Buskirk et al. | |
| 6,481,494 | B1 * | 11/2002 | Dusterhoft et al. | 166/51 |
| 6,644,406 | B1 * | 11/2003 | Jones | 166/308.1 |
| 7,108,060 | B2 * | 9/2006 | Jones | 166/177.5 |
| 7,114,562 | B2 | 10/2006 | Fisseler et al. | |
| 7,357,178 | B2 * | 4/2008 | Thornton | 166/241.6 |
| 7,604,059 | B2 * | 10/2009 | Thornton | 166/381 |
| 7,637,317 | B1 * | 12/2009 | Hernandez et al. | 166/177.5 |
| 7,690,427 | B2 * | 4/2010 | Rispler | 166/293 |
| 7,721,799 | B2 | 5/2010 | Baski | |
| 8,443,891 | B2 * | 5/2013 | Lewis et al. | 166/308.1 |
| 8,453,743 | B2 * | 6/2013 | Lewis et al. | 166/308.1 |
| 2003/0164236 | A1 | 9/2003 | Thornton | |
| 2004/0050551 | A1 * | 3/2004 | Jones | 166/308.5 |
| 2008/0128131 | A1 * | 6/2008 | Nguyen et al. | 166/280.2 |
| 2009/0223667 | A1 * | 9/2009 | Rispler | 166/292 |
| 2010/0084137 | A1 * | 4/2010 | Surjaatmadja et al. | 166/373 |
| 2011/0146994 | A1 * | 6/2011 | Lewis et al. | 166/308.1 |
| 2011/0146995 | A1 * | 6/2011 | Lewis et al. | 166/308.1 |
| 2012/0152523 | A1 * | 6/2012 | Hofman et al. | 166/177.5 |
| 2012/0205121 | A1 * | 8/2012 | Porter et al. | 166/373 |
| 2012/0217013 | A1 * | 8/2012 | O'Malley | 166/308.1 |
| 2013/0032350 | A1 * | 2/2013 | Potapenko et al. | 166/308.1 |
| 2013/0062077 | A1 * | 3/2013 | Surjaatmadja et al. | 166/386 |
| 2013/0081817 | A1 * | 4/2013 | Norrid et al. | 166/305.1 |

OTHER PUBLICATIONS

Clem et al. "A Pragmatic Approach to Frac-Pack Tool Erosion Qualification Testing," SPE Annual Technical Conference and Exhibition, Sep. 19-22, 2010, Florence, Italy. [Abstract and Introduction Only].

(Continued)

*Primary Examiner* — Jennifer H Gay
(74) *Attorney, Agent, or Firm* — Cantor Colburn LLP

(57) ABSTRACT

A downhole apparatus positionable along a pipe string in a wellbore. The apparatus including a tubular structure having an outermost diameter greater than an outer diameter of an adjacent portion of the pipe string. A first end face facing a flow path in the wellbore, and at least one indentation or protuberance provided on an outer surface of the tubular structure. The at least one indentation or protuberance arranged to cause particulates in slurry within the flow path to collect and remain in a vicinity of the tubular structure. A method of diverting fracturing treatments in a wellbore is also included.

18 Claims, 4 Drawing Sheets

(56) References Cited

OTHER PUBLICATIONS

Kundert, Donald and Mike Mullen. "Proper Evaluation of Shale Gas Reservoirs Leads to a More Effective Hydraulic-Fracture Stimulation," SPE Rocky Mountain Petroleum Technology Conference, Apr. 14-16, 2009, Denver, Colorado. [Abstract and Introduction Only].

Clem et al. "The Science Behind Erosion Qualification Testing of Frac Pack Tools." SPE Deepwater Drilling and Completions Conference, Oct. 5-6, 2010, Galveston, Texas, USA. [Abstract and Introductioin Only].

International Search Report and Written Opinion, date of mailing Sep. 12, 2012; International Application No. PCT/US2012/022319, Korean Intellectual Property Office; Written Opinion 6 pages; International Search Report 3 pages.

* cited by examiner

HYDRAULIC FRACTURE DIVERTER APPARATUS AND METHOD THEREOF

BACKGROUND

In recent technology related to downhole drilling and completion, fracturing has become more prevalent. Fractures are created mostly from pressure, however sometimes there will be proppant in the slurry used to pressurize the well and that proppant flows into the fractures once open to maintain the fractures in an open condition. Conventionally, hydraulic-set or swelling packers have been used to divert such proppant, however these can be complicated and subject to failure. Since causing and maintaining fractures to be preferentially in zones of interest is desirable, the art is always receptive to new concepts related thereto.

BRIEF DESCRIPTION

A downhole apparatus positionable along a pipe string in a wellbore, the apparatus including a tubular structure having an outermost diameter greater than an outer diameter of an adjacent portion of the pipe string, a first end face facing a flow path in the wellbore, and at least one indentation or protuberance provided on an outer surface of the tubular structure, the at least one indentation or protuberance arranged to cause particulates in slurry within the flow path to collect and remain in a vicinity of the tubular structure.

A method of diverting fracturing treatments in a wellbore, the method including positioning a downhole apparatus along a pipe string in the wellbore, the apparatus including a tubular structure having an outermost diameter greater than an outer diameter of an adjacent portion of the pipe string, a first end face facing a flow path in the wellbore, providing at least one indentation or protuberance on an outer surface of the tubular structure; introducing a slurry into the wellbore and towards the tubular structure; and causing particulates in the slurry to collect in a vicinity of the tubular structure, in a space between the tubular structure and an inner wall of the wellbore, by an arrangement of the at least one indentation or protuberance.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
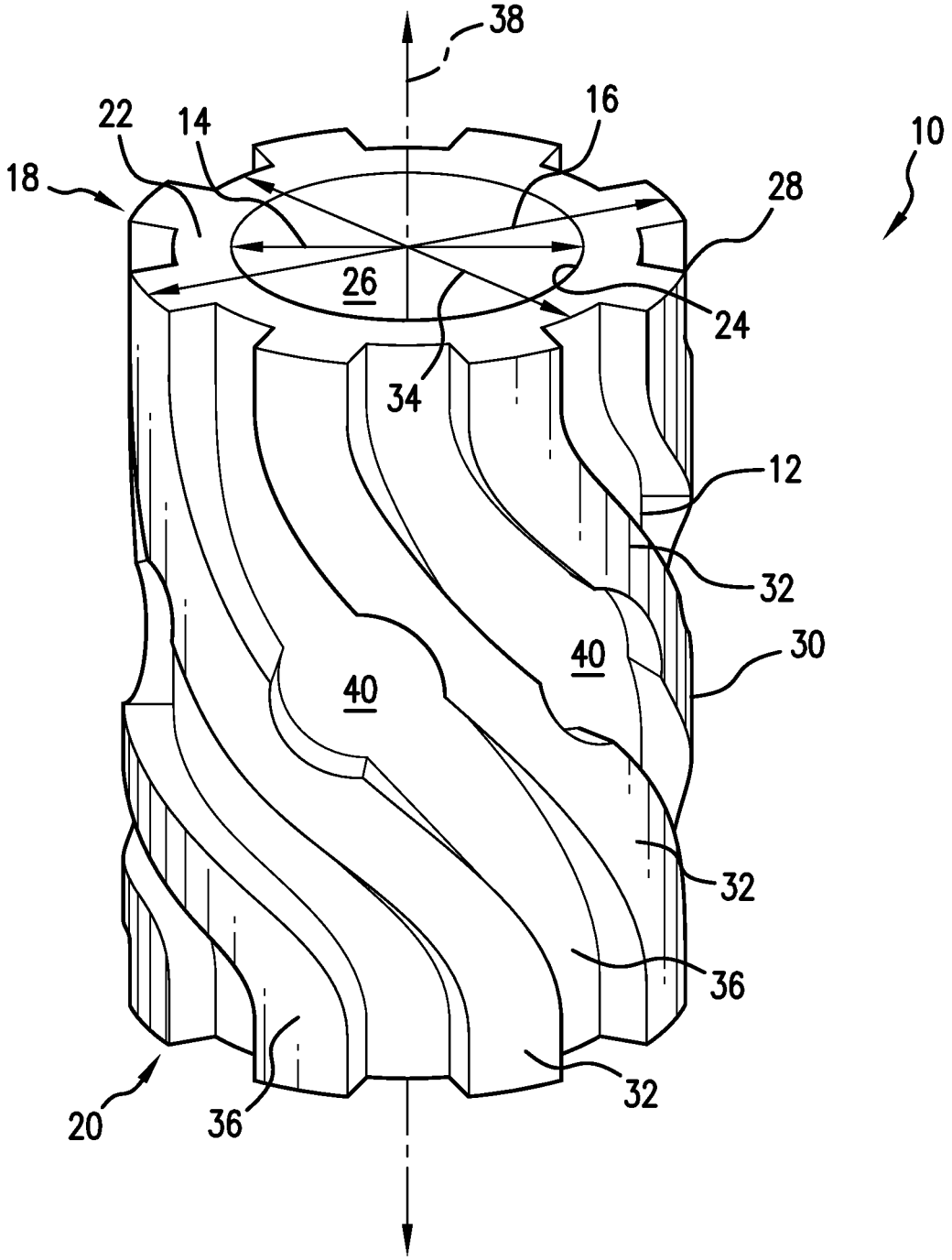
FIG. 1 is a front perspective view of an exemplary embodiment of a tubular structure for a hydraulic fracture diverter apparatus.
Figure 3A:
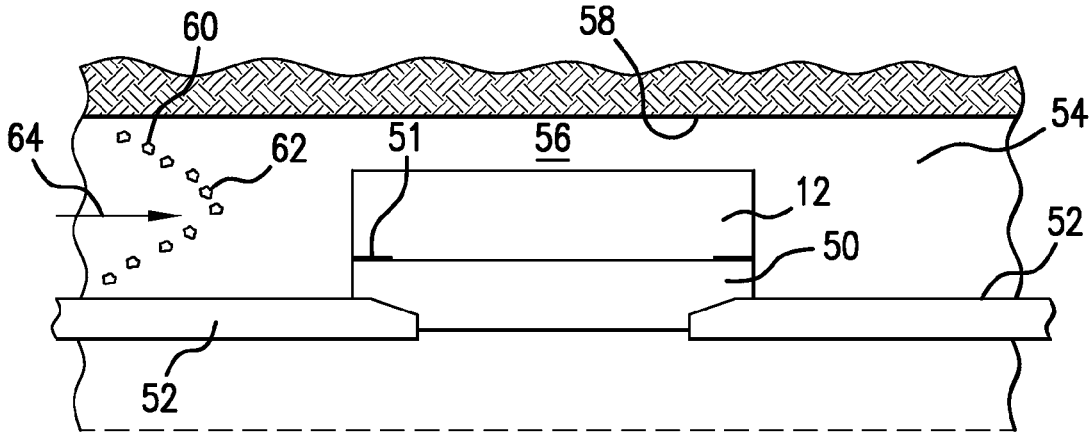
FIG. 3A is a cross-sectional view of a flow of slurry approaching an exemplary embodiment of a tubular structure positioned along a pipe string.
Figure 3B:
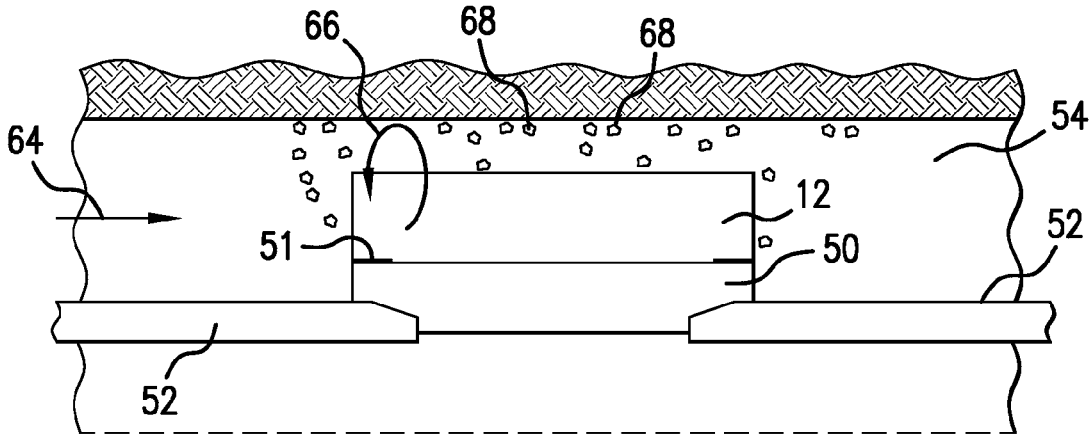
FIG. 3B is a cross-sectional view of particulates within a flow of slurry beginning to collect in a vicinity of the tubular structure.
Figure 3C:
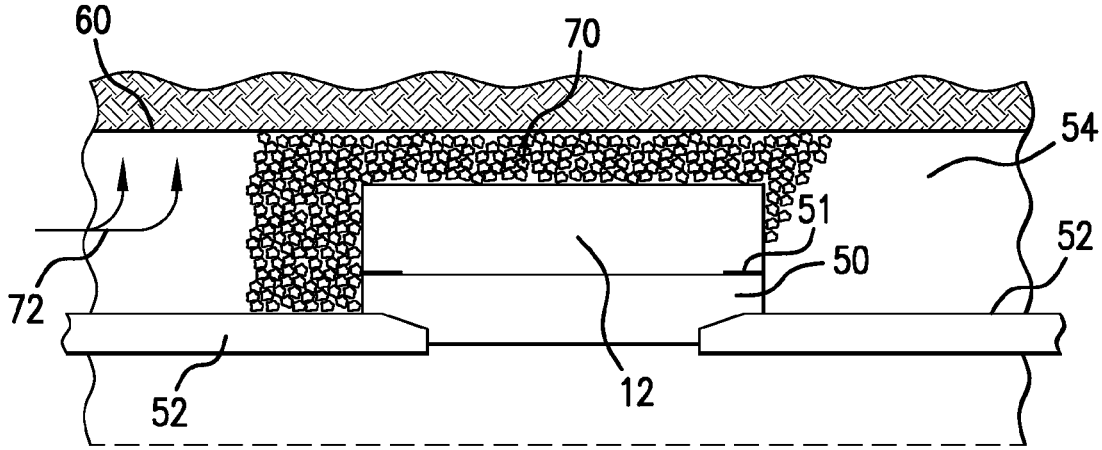
FIG. 3C is a cross-sectional view of the flow being diverted towards a formation of interest by a plug of solids collected about the tubular structure.

With reference to FIG. 1, an exemplary embodiment of a hydraulic fracture diverter apparatus 10 includes a substantially tubular shaped structure 12 that may be slipped onto a pipe connection or pipe joint where, or adjacent to where, fracture diversion is desired. The tubular structure 12 may include an inner diameter 14 sized to fit onto the pipe connection, such as by having the inner diameter 14 substantially the same size or only slightly larger than an outer diameter of the pipe connection. The apparatus 10 may include securement devices, such that the tubular structure 12 may be retained in place on the pipe connection with clamps, set screws, welds, interference or any combination of the above. For exemplary purposes, a weld 51 is illustrated in FIGS. 3A-3C. An outermost diameter 16 of the tubular structure 12 is comparatively larger than other structure nearby on the pipe string, for disrupting a flow of slurry as it passes by the tubular structure 12.

With further reference to FIG. 1, the tubular structure 12 includes a first end 18 and a second end 20. In an exemplary embodiment, the structure 12 includes an upstream end, which is one of the first end 18 and second end 20, and a downstream end, which is the other of the first end 18 and the second end 20. The first end 18 includes a first end face 22 and the second end 20 includes a second end face. The first end face 22 includes an inner periphery 24, such as a substantially circular shape, formed by cylindrical opening 26 and a convoluted outer periphery 28. While the inner periphery 24 is described in an exemplary embodiment as substantially circular, it should be understood that any shape of the inner periphery 24 sized for accommodating a pipe joint or portion of pipe string therein would be within the scope of these embodiments. Although not shown, the second end face may include a similar shape as the first end face 22, with an inner periphery sized to accommodate the pipe string and a convoluted outer periphery. In one exemplary embodiment, the tubular structure 12 may be substantially symmetrically formed such that the tubular structure 12 may be reversibly oriented in either the upstream or downstream direction in use. In an alternative exemplary embodiment, the first end face 22 may have a different size and/or shape than the second end face for assisting in the disruption of a flow of slurry as it passes by the tubular structure 12.

Figure 2:
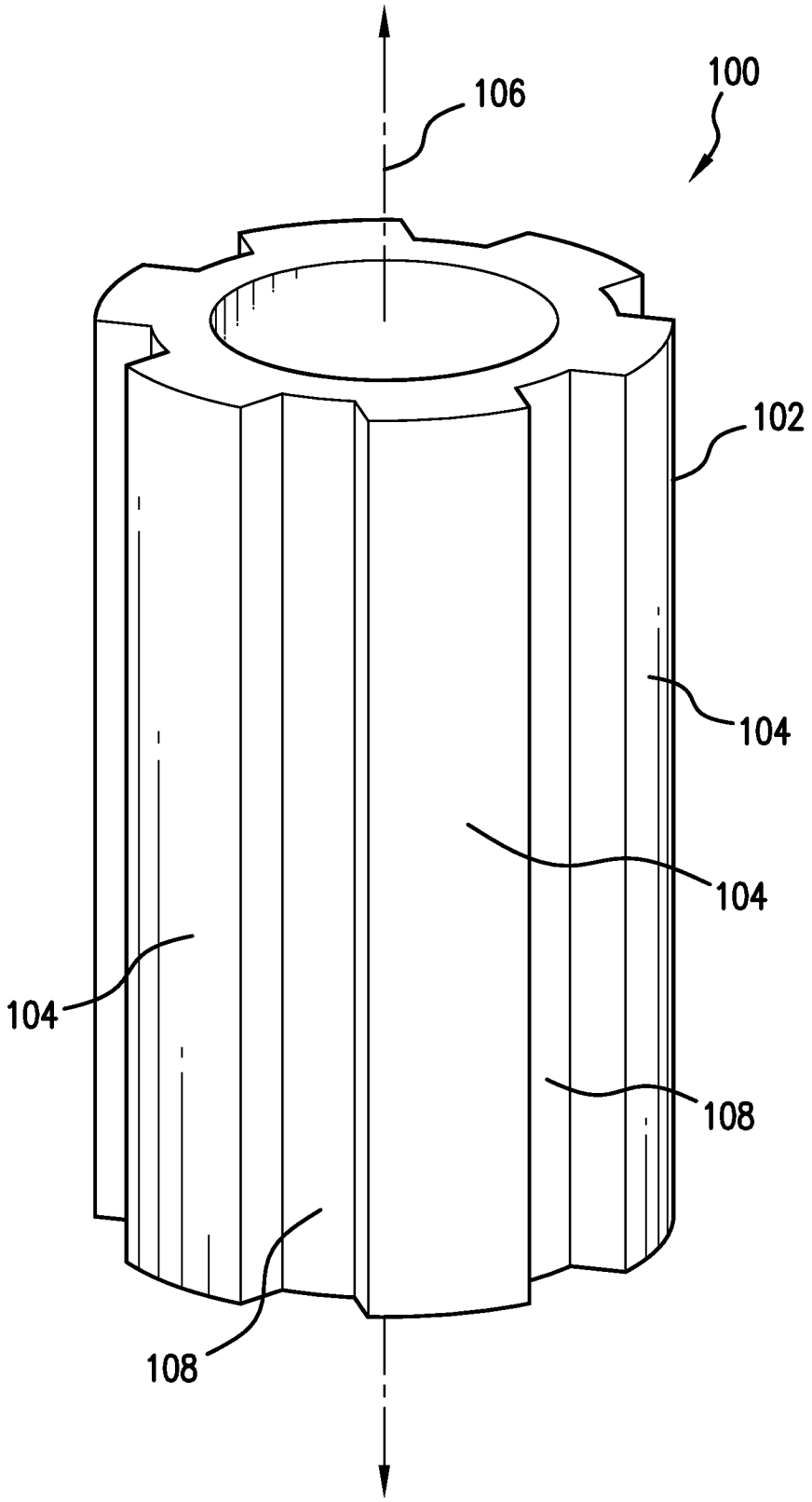
FIG. 2 is a front perspective view of another exemplary embodiment of a tubular structure for a hydraulic fracture diverter apparatus.

An outer surface 30 of the apparatus 10 includes a series of longitudinally extending fins 32 that extend from the first end 18 to the second end 20, such that portions of an outer diameter 34 of the tubular structure 12 are inwardly offset from the outermost diameter 16 of the structure 12 by a series of grooves or indentations 36. In the exemplary embodiment shown in FIG. 1, the fins 32 are curved such that they take on a twisted or partially spiraled arrangement. In another exemplary embodiment, as shown in FIG. 2, a hydraulic fracture diverter apparatus 100 includes a tubular structure 102 with fins 104 that are straight such that they extend parallel with a longitudinal axis 106 of the tubular structure 102. Other than the design of fins 104 and grooves 108, the tubular structure 102 shown in FIG. 2 is substantially the same as the tubular structure 12 shown in FIG. 1 and therefore a detailed description of the tubular structure 102 will not be repeated.

In one exemplary embodiment, adjacent fins 32 are separated by a groove 36 which may have a width substantially the same as or greater than the width of the fins 32. The fins 32 may be evenly spaced apart from each other and evenly radially distributed about the longitudinal axis 38 of the structure 12. As shown in FIG. 1, the grooves 36 that separate adjacent fins 32 may also include expanded portions 40 that are larger in width than a remainder of the grooves 36. In one exemplary embodiment, the expanded portions 40 take on a substantially circular shape with one arc of the circular shape formed by an indent in one fin 32 and another arc of the circular shape formed by an indent in an adjacent fin 32. Also in one exemplary embodiment, the enlargements 40 may be provided in each groove 36 and at a same distance between the first end 18 and second end 20, although, in alternative exemplary embodiments, the enlargements 40 may be located at varying distances from the first end 18 and second end 20. While enlargement 40 has been shown and described with reference to circular portions of grooves 36, other types of disruptions may be provided in either the grooves 36 or fins 32 in order to disrupt the flow of slurry passing by the tubular structure 12. The tubular structure 12 may have a first wall thickness measured from the inner periphery 24 of the tubular structure 12 to the outermost surface of the fin 32, and a second wall thickness measured from the inner periphery 24 to an outer surface of the groove 36. A difference between the first thickness and the second thickness may define a thickness of the fins 32. The first and second thicknesses may be adjusted to achieve a desired flow disruption. While curved and straight fins 32, 104 have been respectively shown in FIGS. 1 and 2, it should be understood that other fin structures would be within the scope of these embodiments, including, but not limited to, spiral fins, zig zag fins, circular fins, etc. Also, while it has been described that the grooves 36, 108 and fins 32, 104 extend from the first ends to the second ends of the tubular structures 12, 102, alternate exemplary embodiments may include indentations that are evenly or sporadically distributed about the outer surface of a tubular structure, such that the indentations are arranged to cause particulates in slurry within the flow path to collect and remain in a vicinity of the tubular structure. Likewise, protuberances of varying sizes and shapes may also be distributed on the outer surface of the tubular structure to accomplish the disruption of the flow path such that particulates in slurry collect and remain in the vicinity of the tubular structure. In yet another exemplary embodiment, a combination of indentations and protuberances may be employed. Also, while a unitary tubular structure 12 has been shown and described as sized to fit over a pipe string, joint, or other connection, it should be understood that the tubular structure 12 may also be divided into two or more longitudinally split sections that can be reassembled over any portion of the pipe string and secured thereto using securement or retainment devices.

Turning now to FIGS. 3A-3C, the hydraulic fracture diverter apparatus 10, including the substantially tubular shaped structure 12 as described with respect to the exemplary embodiment shown in FIG. 1, is shown employed on a pipe joint 50 of a pipe string 52 within a wellbore 54. While not shown in FIGS. 3A-3C, it should be understood that the hydraulic fracture diverter apparatus 100, including the substantially tubular shaped structure 102, as well as other hydraulic fracture diverter apparatuses within the exemplary embodiments described herein, may also be employed on the pipe joint 50. An annular space 56 is located between the tubular structure 12 and the inner wall 58 of the wellbore 54. The pipe joint 50, to which the tubular structure 12 is applied, is located adjacent to a formation of interest 60 of the wellbore 54 where fracturing is desired or where fractures are to be maintained with proppant from slurry. The installation of the tubular structure 12 on the pipe joint 50 as described is intended to cause bridging or plugging when a slurry 62 is flowing, as indicated by arrow 64, in the annular space 56 of sufficient intensity.

As illustrated in FIG. 3B, the flow path around the tubular structure 12 in the annular space 56, and through the outer surface 30 of the structure 12 via the grooves and indentations 36, is designed to cause particulates 68 in slurry suspension 62 to collect in the vicinity of the structure 12, either by falling out suspension due to velocity changes or literally being centrifugally separated, as indicated by arrow 66. Once sufficient flow rate and concentration solids is flowing past the structure 12, a bridge or plug of solids 70 is collected as shown in FIG. 3C. Once the plug of solids 70 is created at the area of the tubular structure 12 and at its first end face 22, diversion of the pumped slurry 62 into the formation of interest 60 is forced, as indicated by arrows 72. This effectively creates an isolation device out of slurry, rather than using a packer. Thus, a method for employing the apparatus 10 in a downhole environment as described herein is progressive fracturing, specifically the diversion of fracturing treatments into fractures via the formation of proppant/sand bridges as opposed to the more conventional hydraulic-set or swelling packers.

The tubular structure 12 of the apparatus 10 may function like a centralizer, to help centrally locate the pipe string 52 within the casing or wellbore 54. The tubular structure 12 is placed on a pipe connection 50 adjacent where fracture diversion is desired and the slip on structure 12 is designed to provide some benefit in terms of centralization, either by discrete fins 32, 104 or a single spiral. In the event where particulates 68 are not provided within the flow, the tubular structure 12 may assist in holding the pipe string 52 off of the wall 58 while allowing flow to pass through the grooves and indentations 36, 108 of the tubular structure 12, 102.

Figure 4:
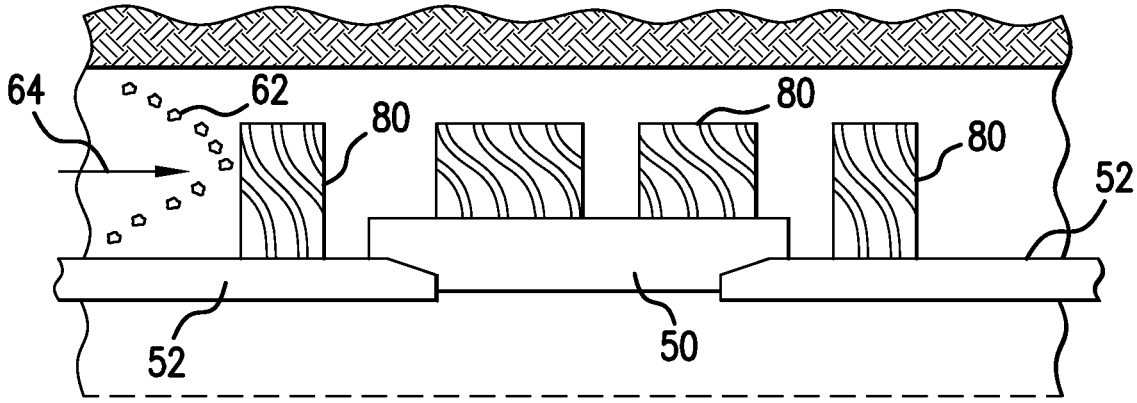
FIG. 4 is a cross-sectional view of a series of upsets for a hydraulic fracture diverter apparatus; and, FIG. 5 is a cross-sectional view of a tool joint designed for use as a hydraulic fracture diverter apparatus.
Figure 5:
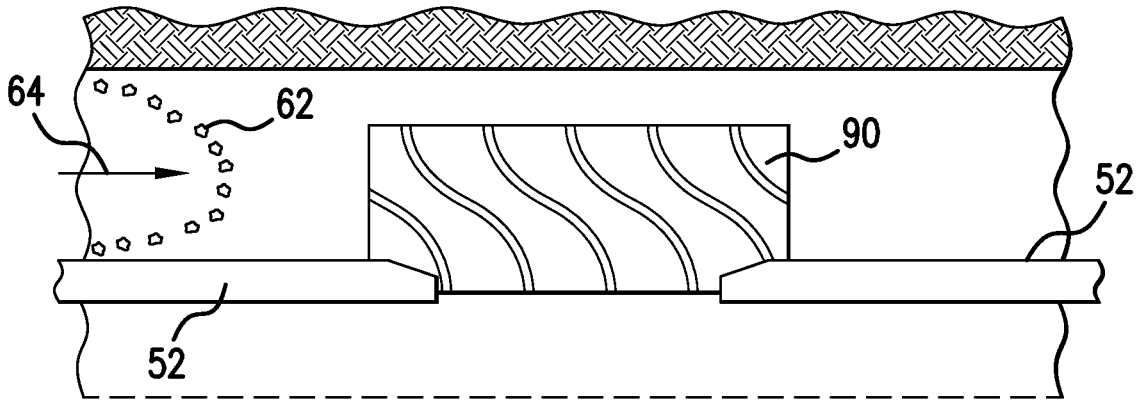

While a tubular structure 12, 102 has been described with respect to FIGS. 1 and 2, the present invention need not be limited thereto. In an alternative exemplary embodiment, as shown in FIG. 4, rather than making the tubular structure a discrete part on one tool joint 50, a distributed series of upsets 80 could be affixed to the pipe string 52 and/or pipe joint 50 to create the same effect. In yet another exemplary embodiment, as shown in FIG. 5, a tool joint 90 could itself be designed to cause or enhance this effect rather than employing a separate tubular structure 12 on a pipe joint 50. And in yet other exemplary embodiments, parts placed upstream of the tool or pipe joint 50 could encourage bridges 70 to form at the tool or pipe joint 50.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A downhole apparatus positionable along a pipe string in a wellbore, the apparatus comprising:

a tubular structure having an outermost diameter greater than an outer diameter of an adjacent portion of the pipe string, a first end face facing a flow path in the wellbore, a set of longitudinally extending indentations extending longitudinally from the first end face to a second end face and provided on an outer surface of the tubular structure, a set of radially arranged fins alternately separated by the indentations, and at least one indentation within the set of indentations having a disruption, the disruption being an enlargement positioned between the first and second end faces, the enlargement having a width greater than a width of the at least one indentation adjacent the first end face and greater than a width of the at least one indentation adjacent a second end face of the tubular structure, the enlargement partially formed by indents in adjacent fins, the disruption configured to disrupt flow of slurry passing by the tubular structure;

wherein the indentations, fins, and disruption are arranged to cause particulates in slurry within the flow path to collect and remain in a vicinity of the tubular structure.

2. The apparatus of claim 1, wherein the indentations are spirally arranged from the first end face to the second end face.

3. The apparatus of claim 1, wherein the indentations extend parallel with a longitudinal axis of the tubular structure.

4. The apparatus of claim 1, wherein the tubular structure includes an inner diameter sized to cover a pipe connection of the pipe string.

5. The apparatus of claim 4, further comprising a securement securing the tubular structure to the pipe connection.

6. The apparatus of claim 5, wherein the securement is a clamp, set screw, weld, or interference.

7. The apparatus of claim 1, wherein the tubular structure is integrally formed with the pipe string.

8. The apparatus of claim 1, further comprising a plurality of the tubular structures distributed along the pipe string.

9. The apparatus of claim 1, wherein the enlargement has a substantially circular shape and the indents are arcs.

10. A method of diverting fracturing treatments in a wellbore, the method comprising:

positioning a downhole apparatus along a pipe string in the wellbore, the apparatus including a tubular structure having an outermost diameter greater than an outer diameter of an adjacent portion of the pipe string, a first end face facing a flow path in the wellbore;

providing a plurality of radial fins spaced apart from each other by a plurality of indentations inwardly offset from the fins on an outer surface of the tubular structure;

introducing a slurry into the wellbore and towards the tubular structure; and causing particulates in the slurry to collect in a vicinity of the tubular structure, in a space between the tubular structure and an inner wall of the wellbore, by an arrangement of the radial fins and indentations.

11. The method of claim 10, wherein causing particulates in the slurry to collect in a vicinity of the tubular structure includes changing velocity of the slurry as the slurry moves past the tubular structure.

12. The method of claim 10 further comprising providing a plurality of the tubular structures along the pipe string.

13. The method of claim 10, wherein positioning the downhole apparatus along a pipe string includes integrally forming the tubular structure with a pipe joint.

14. A method of diverting fracturing treatments in a wellbore, the method comprising:

positioning a downhole apparatus along a pipe string in the wellbore, the apparatus including a tubular structure having an outermost diameter greater than an outer diameter of an adjacent portion of the pipe string, a first end face facing a flow path in the wellbore;

providing at least one indentation or protuberance on an outer surface of the tubular structure;

introducing a slurry into the wellbore and towards the tubular structure; and causing particulates in the slurry to collect in a vicinity of the tubular structure, in a space between the tubular structure and an inner wall of the wellbore, by an arrangement of the at least one indentation or protuberance, wherein causing particulates in the slurry to collect in a vicinity of the tubular structure includes centrifugally separating the particulates from the slurry as the slurry moves past the tubular structure.

15. The method of claim 10, further comprising collecting a plug of solids about the tubular structure and plugging an annular space between the tubular structure and the wellbore.

16. The method of claim 15, subsequent plugging the annular space, further comprising diverting the slurry into a formation of interest.

17. A method of diverting fracturing treatments in a wellbore, the method comprising:

positioning a downhole apparatus along a pipe string in the wellbore, the apparatus including a tubular structure having an outermost diameter greater than an outer diameter of an adjacent portion of the pipe string, a first end face facing a flow path in the wellbore;

providing at least one indentation or protuberance on an outer surface of the tubular structure and further providing a disruption in the at least one indentation or protuberance to assist in causing particulates in the slurry to collect in a vicinity of the tubular structure;

introducing a slurry into the wellbore and towards the tubular structure; and causing particulates in the slurry to collect in a vicinity of the tubular structure, in a space between the tubular structure and an inner wall of the wellbore, by an arrangement of the disruption and the at least one indentation or protuberance.

18. The method of claim 17, wherein providing a disruption includes providing a substantially circular shaped enlargement in the at least one indentation.

* * * * *